US007287957B2

(12) United States Patent
Jahns et al.

(10) Patent No.: US 7,287,957 B2
(45) Date of Patent: Oct. 30, 2007

(54) INNER SHROUD FOR THE STATOR BLADES OF THE COMPRESSOR OF A GAS TURBINE

(75) Inventors: Ingo Jahns, Mahlow (DE); Olaf Lenk, Berlin (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 144 days.

(21) Appl. No.: 10/989,354

(22) Filed: Nov. 17, 2004

(65) Prior Publication Data

US 2005/0220612 A1 Oct. 6, 2005

(30) Foreign Application Priority Data

Nov. 17, 2003 (DE) ..... 103 53 810

(51) Int. Cl.
*F04D 29/08* (2006.01)
*F01D 11/08* (2006.01)

(52) U.S. Cl. ..... 415/173.7; 415/174.4

(58) Field of Classification Search ..... 415/160, 415/161, 200, 174.4, 174.5, 171.1, 173.7, 415/209.4, 210.1, 209.3
See application file for complete search history.

(56) References Cited

U.S. PATENT DOCUMENTS

| | | | |
|---|---|---|---|
| 3,849,023 | A | 11/1974 | Klompas |
| 4,655,682 | A | 4/1987 | Kunz et al. |
| 5,062,767 | A | 11/1991 | Worley et al. |
| 5,421,703 | A | 6/1995 | Payling |
| 6,425,736 | B1 | 7/2002 | McMahon et al. |
| 6,790,000 | B2 | 9/2004 | Wolf |

FOREIGN PATENT DOCUMENTS

| | | |
|---|---|---|
| DE | 19518203 | 12/1995 |
| DE | 10161292 | 6/2003 |
| EP | 0171329 | 2/1986 |
| EP | 0602631 | 6/1994 |
| GB | 1366075 | 9/1974 |
| GB | 2203197 | 10/1988 |

OTHER PUBLICATIONS

European Search Report dated Dec 23, 2004.
German Search Report dated Jul. 8, 2004.

*Primary Examiner*—Edward K. Look
*Assistant Examiner*—Dwayne J White
(74) *Attorney, Agent, or Firm*—Timothy J. Klima

(57) ABSTRACT

An inner shroud (6) for the stator blades (3) of the compressor of a gas turbine is a plastic component and includes certain additives, which may be concentrated in partial areas for specific functionality, and/or pre-manufactured inserts for sealing, ensuring sliding properties, wear protection and/or setting heat expansion. Such an inner shroud made of plastic material fulfills all requirements usually imposed on inner shrouds made of metal, while being simply producible and having low weight.

20 Claims, 2 Drawing Sheets

INNER SHROUD FOR THE STATOR BLADES OF THE COMPRESSOR OF A GAS TURBINE

This application claims priority to German Patent Application DE10353810.0 filed Nov. 17, 2003, the entirety of which is incorporated by reference herein.

BACKGROUND OF THE INVENTION

This invention relates to an inner shroud for the stator blades of a gas turbine, in particular an aircraft turbine, which is provided with means for the rotatable support of the stator blades and for the provision of a seal between the rotor stages and against a secondary air system.

On a gas turbine, for example the compressor arranged upstream of the combustion chamber, one stator blade row each is arranged between adjacent rotor stages. The forward stator blade stages are variable. The variable stator blades are supported on spigots in the compressor casing. The inner shroud is arranged at the inner spigot of the stator blades. The variable stator blades serve to guide the air at an optimal angle into the subsequent rotor stage.

The circular inner shroud for the stator blade row is usually made of a steel or aluminum alloy and normally includes two semi-circular ring segments which may also be split in the axial direction, in which case they are secured to each other by suitable fasteners upon assembly. One main function of the inner shroud is to rotatably support the individual stator blade by means of a spigot which is connected to the stator blade and located in a plain bearing bushing fixed in the inner shroud. As the inner shroud is made of a metallic material, the required mechanical properties, such as stiffness and strength, and a high resistance against erosion or foreign object impact are ensured. In a further main function, the inner shroud provides a seal against the rotor to prevent compressed air from recirculating from areas with higher pressure into areas with lower pressure. For this purpose, sealing fins are provided on the rotor opposite of an abradable sealing ring which is separately fitted to the inner shroud supporting the stator blades. Finally, in still another main function, the inner shroud provides a seal against the secondary air system. This is effected, for example, by the interaction of a static seal and a mating sealing face of the inner shroud.

While the inner shrouds of the type specified above satisfy the requirements for strength and heat expansion, they are disadvantageous in that their manufacture by forging and subsequent machining is time and cost-consuming and, further, in that the inner shroud has high weight. In addition, the manufacturing effort is very high, due to the fact that the plain bearing bushes and the seals, as separately manufactured components, are costly and must be fitted or assembled individually.

In order to avoid the disadvantages resulting from high weight, Patent Specification U.S. Pat. No. 5,062,767 already proposes an inner shroud for the stator blade row which includes a C-shaped steel ring into which abutting segments made of a ceramic material are inserted. The spigots of the stator blades are located in the ceramic segments, these segments having low weight, good strength and sliding properties and being temperature and erosion-resistant. The arrangement of the ceramic segments in the steel ring ensures that the inner shroud has thermal expansion characteristics which, all in all, harmonize with the prevailing temperatures and the thermal expansion of the other components of the compressor. While this design provides for weight reduction and the required thermal expansion, it is again disadvantageous in that the manufacturing effort for the inner shroud of the metallic ring, the ceramic segments and the separate sealing elements, is still high.

BRIEF SUMMARY OF THE INVENTION

This invention, in a broad aspect, provides for an inner shroud for the stator blades of the compressor of a gas turbine which has low weight, is easily and inexpensively manufacturable and satisfies all requirements with regard to heat expansion, strength, temperature resistance, resistance to foreign object impacts, as well as sliding and sealing properties.

It is a particular object of the present invention to provide solution to the above problems by an inner shroud designed in accordance with the features described herein. Further features and advantageous embodiments of the present invention will be apparent from the present description.

This invention, in its essence, provides for an inner shroud which is produced as a one-piece plastic component by a known injection molding or another suitable process and contains additives, such as glass and/or carbon fibers and/or graphite or pre-manufactured fixed inserts, to obtain the specific functions required of partial areas of the inner shroud. Preferably, certain additives are concentrated in these specific functional areas of the plastic component. Accordingly, an anti-wear layer including long fibers embedded in the plastic or in the form of a wear-protective cladding formed in during the injection molding process is provided in the area of the inner shroud which is directly subject to the airflow. In the area of the inner shroud in which the stator blades are rotatably supported, a high content of an additive with good sliding properties, such as graphite, is provided in the plastic material. For sealing towards the rotor blade row, an abradable layer is integrated into the plastic material which includes either of the base material, an accumulation of additives introduced in high concentration during manufacture, or a pre-manufactured molded part which is formed in during manufacture and is abradable by the sealing fins on the rotor. Since the inner shroud is made as a plastic component, sealing to the secondary air system can preferably be effected by an elastic sealing lip formed from the plastic component which, by virtue of the additives (concentration or type of additives), has the elasticity required to make contact with a sealing face under the existing air pressure. Furthermore, the plastic material is advantageous in that it expands under the influence of heat, as required for the inner shroud. In addition, the additives present in the plastic material ensure that the heat expansion of the inner shroud is in harmony with that of the adjacent components.

The inner shroud, which is made in one piece by injection molding or other suitable processes from plastic material with the necessary additives or with pre-manufactured inserts, is used in accordance with the heat resistance of the plastic material, i.e. preferably in the first stages of the compressor of an aircraft turbine. Particularly advantageous are the low weight, and the simple, cost-effective manufacture of such an inner shroud. In the manufacturing process, the feed of material, both in terms of time and space, is controllable such that plastic material with a prescribed content of additives can be fed to specific areas of the mould. Pre-manufactured inserts for certain functional areas are inserted in the mold and formed into the plastic material during the molding process.

The inner shroud includes two semi-circular plastic components which, together, form the annular inner shroud. The plastic components can, however, also be split in the axial direction. In this case, the two components, after being joined during assembly, are held together by a threaded connection, such as by a bolt engaging either directly the plastic or a threaded bush formed into the plastic material. If connected by bolts and nuts, the plastic component is reinforced in the respective areas by additives or a bush formed into both halves.

BRIEF DESCRIPTION OF THE DRAWINGS

Embodiments of the present invention are more fully described in the light of the accompanying drawings. In the drawings.

DETAILED DESCRIPTION OF THE INVENTION

Figure 1:
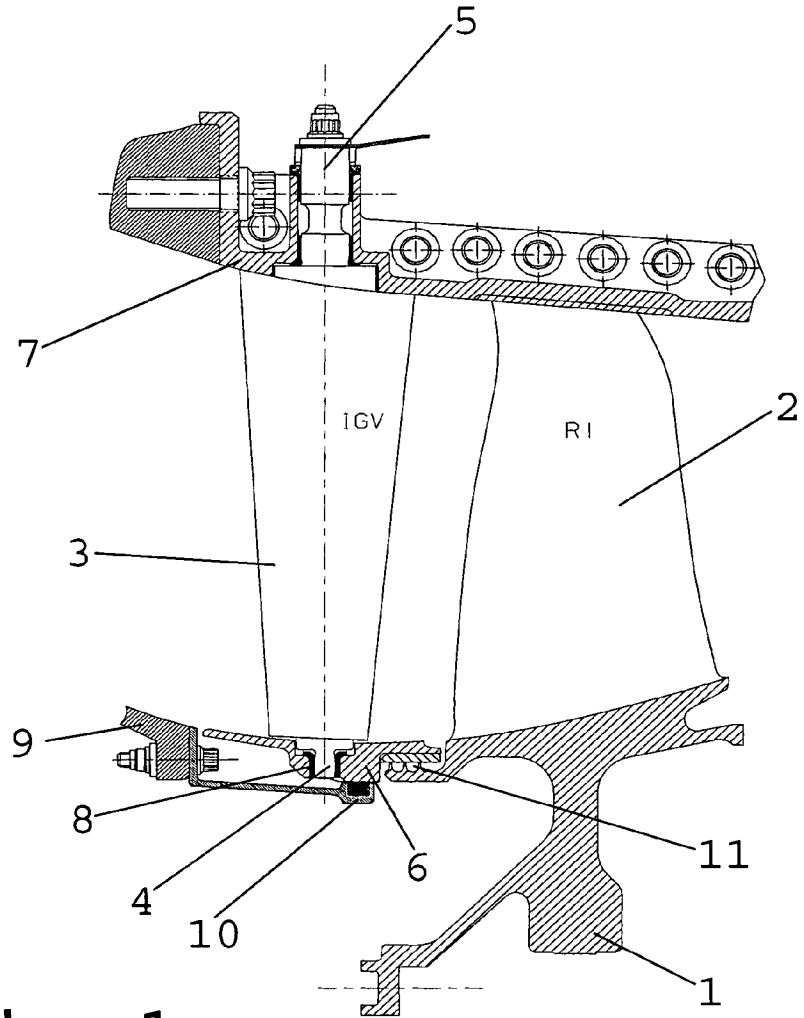
FIG. 1 is a partial view of a compressor for an aircraft turbine with a stator upstream of the first rotor stage, with the stator featuring a conventional inner shroud.

The state-of-the-art compressor shown in FIG. 1 for clarification of the integration of the inner shroud into the compressor usually comprises a rotor 1 having several rotor stages, each comprising a rotor blade row, and stators, each comprising a stator blade row and arranged upstream of the respective rotor stage. FIG. 1 shows a rotor blade 2 of the first rotor stage with an upstream stator blade 3. The stator blade 3 is rotatably and variably supported in a non-split metallic inner shroud 6 and in the compressor casing 7 by means of inner and outer spigots 4 and 5 connected to the stator blade 3, to enable a desired angle of air incidence to the next rotor stage to be set. The inner spigot 4 is supported in a plain bearing bushing 8. A static (first) seal 10 is attached to a casing section 9 of the aircraft turbine, this static seal interacting with a sealing face on the inner shroud 6 to provide a seal against the secondary air system. A dynamic (second) seal 11 is provided between the inner shroud and the rotor stage.

Figures 2, 3:
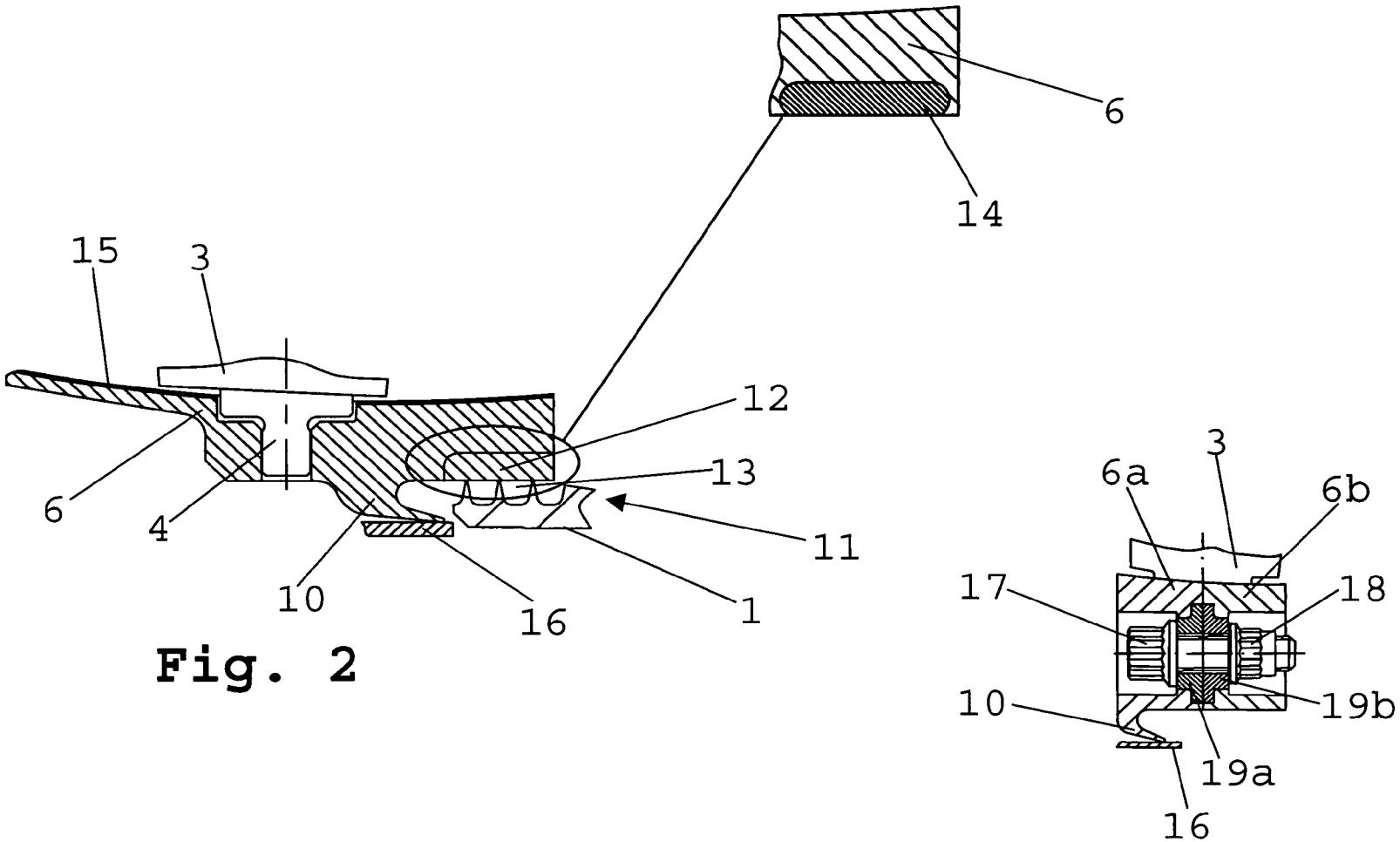
FIG. 2 is a sectional view of a non-split inner shroud made of plastic material in accordance with the present invention, with a stator blade being rotatably supported in this inner shroud.
FIG. 3 is a sectional view of an axially split inner shroud in accordance with the present invention, but without any sealing provision to the rotor stage.

The non-split inner shroud 6 provided in accordance with FIG. 2 on the basis of the present invention, which is integrated into the compressor in the manner described above, includes a one-piece plastic component manufactured by injection molding or another suitable process, into which carbon and/or glass fibers are included to obtain a prescribed heat expansion characteristic. The integrated fiber materials also serve for influencing the strength and elasticity of the plastic component. In addition, the plastic component can also contain graphite in order to improve the sliding and seating properties in the area of the location of the inner spigot 4 and the dynamic seal 11. The dynamic seal 11 includes an abradable layer (sliding layer) 12 in the material of the plastic component which makes contact with sealing fins 13 provided on the rotor 1. As is shown in FIG. 2 by way of the detail Z of a variant of the present invention, the abradable layer can also include a pre-manufactured insert 14 made of a different material having appropriate abrasion and sliding properties and formed into the plastic component during the injection molding process. Similarly, a plain bearing bushing (not shown) can also be form-fitted into the plastic component in the area of the location of the inner spigot 4.

In addition, it is possible that additives with certain properties can be introduced in concentrated form into the bearing or abradable area of the plastic component in order to form a highly effective sliding or abradable layer integral with the plastic material. This is exemplified in FIG. 2, showing an anti-wear layer 15 provided on the air passage side of the inner shroud 6 by means of additives introduced in concentrated form into the plastic material in this area. However, the anti-wear layer 15 can also be an insert, for example in sheet-metal, formed into the plastic component during injection molding. The static (first) seal 10 comprises a sealing lip formed from the plastic component which, by virtue of its flexural elasticity and also under the effect of the high pressure present on the side of the first rotor stage, elastically makes contact with the mating, stationary sealing element 16 of the casing section 9. Besides the above mentioned use of graphite for setting the sliding properties, various fibers, for example, glass, carbon and/or metal fibers, are provided as additives to obtain the various functions of the plastic component. To obtain the desired functions, these fibers can be introduced in different lengths at the desired positions, e.g. long fibers are desirable for anti-wear layers, while short fibers are adequate for setting the basic mechanical strength and the heat expansion behavior.

In the embodiment of an axially split inner shroud according to FIG. 3, which includes two separate plastic components (inner shroud halves 6*a*, 6*b*), each manufactured in one piece by injection molding or other suitable methods, only the first (static) seal 10 in the form of the sealing lip is provided and formed onto the first inner shroud half 6*a*. The two inner shroud halves 6*a*, 6*b* are secured to each other by threaded connections, each including a bolt 17 and a nut 18. In order to prevent the plastic components (inner shroud halves) from being damaged by the threaded connection, bushes 19*a*, 19*b* are formed into the plastic material, these bushes being capable of taking up the forces applied as the connection is made. A specific strength in this area can, however, also be obtained by a high additive content (fiber content). Other types of threaded, clamping or joining connections can also be used to connect the shroud halves.

LIST OF REFERENCE NUMERALS

1 Rotor
2 Rotor blade
3 Stator blade
4 Inner spigot of 3
5 Outer spigot of 3
6 Inner shroud
6*a*, 6*b* Inner shroud halves
7 Compressor casing
8 Plain bearing bushing
9 Casing section
10 First (static) seal (sealing lip)
11 Second (dynamic) seal
12 Abradable layer of 11
13 Sealing fins of 11
14 Insert (abradable layer insert) of 11
15 Anti-wear layer (anti-wear insert)
16 Sealing element of 9
17 Bolt
18 Nut
19*a/b* Bushes

What is claimed is:

1. An inner shroud for stator blades of a compressor of a gas turbine having provision for the rotatable support of the stator blades and for sealing between at least one of the rotor stages and a secondary air system, the inner shroud being a molded plastic component into which specific additives are included, wherein at least one specific mechanical property selected from the group of properties of (anti-wear, sliding, seating, abradability, sealing, elasticity, thermal expansion, heat resistance, moldabiity and strength), required by specific functions of certain localized partial areas of the inner shroud is locally enhanced by at least one of: the concentration of additives into such localized partial areas which will produce the specific properties, and the inclusion in such localized partial areas of molded-in pre-manufactured inserts having such properties.

2. An inner shroud in accordance with claim 1, wherein the plastic component contains additives in the form of at least one of: fiber and powder form.

3. An inner shroud in accordance with claim 2, wherein the additives comprise at least one of: metal fibers, carbon fibers, glass fibers of variable length, and graphite.

4. An inner shroud in accordance wit claim 3, wherein the additives are locally enriched in the inner shroud to form at least one of: an anti-wear layer on an air impingement side of the inner shroud, a static seal in the form of an elastic sealing lip on a sealing side towards at least one of the secondary air system and a following rotor stage, an abradable layer with specific abrasion/wear properties opposing sealing fins provided on the rotor, and a sliding layer In an area of contact surface to the rotatably supported stator blades.

5. An inner shroud in accordance with claim 1, wherein the pre-manufactured inserts include at least one of; a plain bearing bushing having specific sliding properties for the support of the stator blades, cladding having anti-wear properties for erosion protection, and an abradable insert having abrasion and sealing properties for sealing towards die rotor.

6. An inner shroud in accordance wit claim 1, wherein the inner shroud is axially split into two inner shroud halves which are connected together wit fasteners.

7. An inner shroud in accordance with claim 6, wherein the fastener is a threaded connection, including an attaching bolt being threadable directly into at least one of: the plastic material of the inner shroud, and a threaded bush formed into the plastic material of the inner shroud.

8. An inner shroud in accordance with claim 6, wherein the fastener includes a bolt-nut connection, with bushes for receiving the bolts formed into the inner shroud, the bushes being constructed of a high-strength material to protect the plastic material of the inner shroud.

9. An inner shroud in accordance with claim 6, wherein the inner shroud is a molded plastic/fiber composite component.

10. An inner shroud in accordance with claim 6, wherein the inner shroud includes both the concentration of additives into certain areas to produce specific properties, and the inclusion of pre-manufactured inserts having specific properties in certain areas.

11. An inner shroud in accordance with claim 1, wherein the inner shroud includes both the concentration of additives into certain areas to produce specific properties, and the inclusion of pre-manufactured inserts having specific properties in certain areas.

12. An inner shroud in accordance with claim 4, wherein the additives are locally enriched in the inner shroud to form at least two of: the anti-wear layer, the static seal, the abradable layer, and the sliding layer.

13. An inner shroud in accordance with claim 12, wherein the additives are locally enriched in the inner shroud to form at least three of: the anti-wear layer, the stalic seal, the abradable layer, and the sliding layer.

14. An inner shroud in accordance with claim 13, wherein the additives are locally enriched in the liner shroud to form each of; the anti-wear layer, the static seal, the abradable layer, and the sliding layer.

15. An inner shroud in accordance wit claim 5, wherein the pre-manufactured inserts include at least two of: the plain bearing bushing, the cladding, and the abradable insert.

16. An inner shroud in accordance with claim 15, wherein the pre-manufactured inserts include each of: the plain bearing bushing, the cladding, and the abradable insert.

17. An inner shroud in accordance with claim 4, wherein the pre-manufactured inserts include at least one of: a plain bearing bushing having specific sliding properties for the support of the stator blades, cladding having anti-wear properties for erosion protection, and an abradable insert having abrasion and sealing properties for scaling towards the rotor.

18. An inner shroud in accordance with claim 17, wherein the inner shroud includes both the concentration of additives into certain areas to produce specific properties, and the inclusion pre.-manufactured inserts having specific properties in certain areas, wherein the additives are locally enriched in the inner shroud to form at least one of: the anti-wear layer, the static seal, the abradable layer, and the sliding layer and the pre-manufactured inserts include at least one of: the plain bearing bushing, the cladding, and the abradable insert.

19. An inner shroud in accordance with claim 18, wherein the additives are locally enriched in the inner shroud to form at least two of: the anti-wear layer, the static seal, the abradable layer, and the sliding layer.

20. An inner shroud in accordance wit claim 18, wherein the pre-manufactured inserts include at least two of; the plain bearing bushing, the cladding, and the abradable insert.

* * * * *